United States Patent [19]

Bearden, Jr. et al.

[11] Patent Number: 4,548,700

[45] Date of Patent: Oct. 22, 1985

[54] HYDROCONVERSION PROCESS

[75] Inventors: Roby Bearden, Jr.; Clyde L. Aldridge, both of Baton Rouge, La.

[73] Assignee: Exxon Research and Engineering Co., Florham Park, N.J.

[21] Appl. No.: 561,475

[22] Filed: Dec. 14, 1983

[51] Int. Cl.[4] ..... C10G 1/08; C01G 31/00; C01G 39/00

[52] U.S. Cl. ..... 208/10; 208/108; 208/112; 423/53; 423/61; 423/62; 423/68; 502/28

[58] Field of Search ..... 208/10, 108, 112; 502/28; 423/62, 53, 68, 61

[56] References Cited

U.S. PATENT DOCUMENTS

| | | | |
|---|---|---|---|
| 3,131,142 | 4/1964 | Mills, Jr. . | |
| 3,567,433 | 3/1971 | Gutnikov | 423/53 |
| 3,791,989 | 2/1974 | Mitchell et al. | 502/28 |
| 4,077,867 | 3/1978 | Aldridge et al. . | |
| 4,087,510 | 5/1978 | Steenken | 423/62 |
| 4,089,806 | 5/1978 | Farrell et al. | 502/28 |
| 4,134,825 | 1/1979 | Bearden, Jr. et al. | 208/108 |
| 4,203,759 | 5/1980 | Metrailer et al. | 423/62 |
| 4,243,638 | 1/1981 | Jackovitz et al. | 423/15 |
| 4,382,068 | 5/1983 | Rokukawa | 423/68 |
| 4,485,183 | 11/1984 | Miller et al. | 208/251 H |
| 4,500,495 | 2/1985 | Hubred et al. | 423/53 |

*Primary Examiner*—D. E. Gantz
*Assistant Examiner*—Anthony McFarlane
*Attorney, Agent, or Firm*—Marthe L. Gibbons

[57] ABSTRACT

A slurry hydroconversion process is provided in which a carbonaceous chargestock such as a hydrocarbonaceous oil or coal comprising a catalyst containing vanadium or molybdenum or mixtures thereof, is converted to a hydroconverted oil product. A heavy oil portion comprising metal-containing solids is separated from the oil product and partially gasified to produce a carbon-free metal-containing ash which is extracted with oxalic acid. The resulting metal-containing oxalic acid extract is recycled to the hydroconversion zone as catalyst precursor.

13 Claims, 1 Drawing Figure

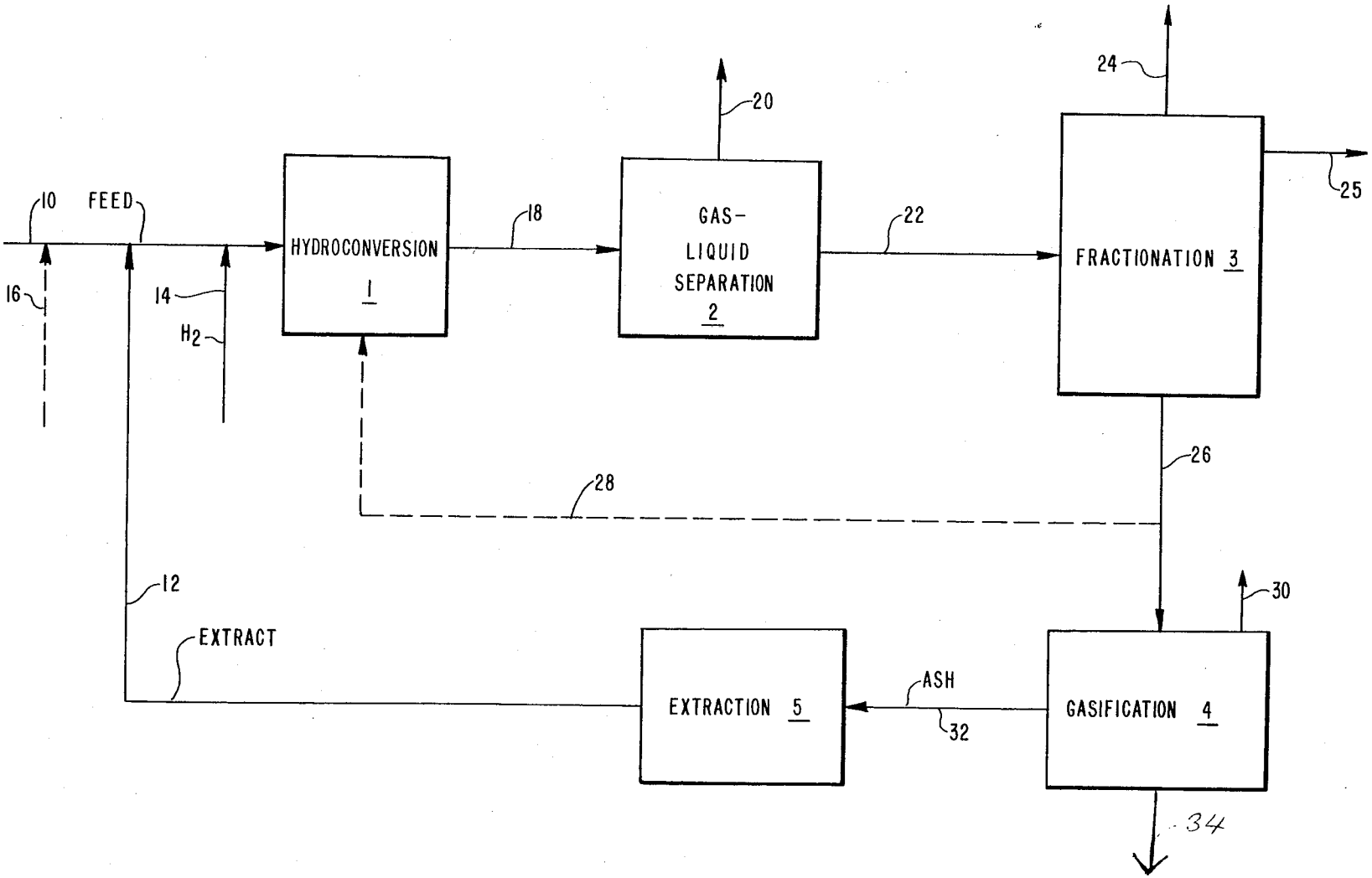
FRACTIONATION 3
GAS-
LIQUID
SEPARATION
2
HYDROCONVERSION
1
GASIFICATION 4
EXTRACTION 5
FEED
H2
EXTRACT
ASH
10
12
14
16
18
20
22
24
25
26
28
30
32
34

HYDROCONVERSION PROCESS

BACKGROUND OF THE INVENTION

1. Field of the Invention

This invention relates to an improvement in a slurry hydroconversion process in which a carbonaceous feed such as a hydrocarbonaceous oil, coal or mixtures thereof, is converted to an oil in the presence of hydrogen and a metal-containing catalyst dispersed in the feed.

2. Description of the Prior Art

Slurry hydroconversion processes conducted in the presence of hydrogen and a hydroconversion catalyst dispersed in the carbonaceous feed are known. The term "hydroconversion" with reference to the oil feed is used herein to designate a process conducted in the presence of hydrogen in which at least a portion of the heavy constitutents (as measured by Conradson carbon residue) of the oil feed is converted to lower boiling hydrocarbonaceous products.

The term "hydroconversion" with reference to the coal feed is used herein to designate conversion of coal to normally liquid hydrocarbon products.

It is also known to produce metal-containing catalysts in situ in the carbonaceous feed from thermally decomposable metal compounds as well as slurry hydroconversion processes utilizing such catalysts, see for example, U.S. Pat. Nos. 4,134,825 and 4,077,867, the teachings of which are hereby incorporated by reference.

Mills' U.S. Pat. No. 3,131,142 discloses a method of removing a hydrocracking residue from a hydrocracking zone, burning the residue to obtain a metal oxide ash, reacting the metal oxide with organic acids extracted from heavy petroleum streams (i.e., naphthenic acids) in the presence of a dilute mineral acid and, thereafter, extracting the resulting metal salts of the organic acids into a hydrogen transfer diluent for subsequent use as hydrocracking catalyst.

It has now been found that in the hydroconversion upgrading of heavy hydrocarbonaceous feedstocks with a dispersed, finely divided catalyst that is prepared in situ in the process feed from a dispersed catalyst precursor compound, that effective catalysts can be formed from dispersions of aqueous solutions of oxalates of vanadium, and molybdenum and that these metals can be recovered selectively (that is, they can be recovered preferentially with respect to metals that are indigenous to most heavy feeds, such as nickel, iron, sodium and calcium) for effective reuse in the process by aqueous oxalic acid extraction of the metal-containing ash obtained when the catalyst-containing bottoms of the hydroconversion product is partially gasified to remove coke.

SUMMARY OF THE INVENTION

In accordance with the invention, there is provided, in a slurry hydroconversion process wherein a carbonaceous chargestock containing a catalyst or catalyst precursor comprising a metal selected from the group consisting of vanadium, molybdenum, and mixtures thereof, is reacted with a hydrogen-containing gas at hydroconversion conditions to produce a hydroconverted oil product comprising solids containing said metal, separating a heavy oil portion comprising said metal-containing solids from said hydroconverted oil; gasifying at least a portion of said separated heavy oil portion to produce a metal-containing ash, the improvement which comprises contacting said metal-containing ash with oxalic acid to extract said metal from said ash, and adding at least a portion of the resulting metal-containing oxalic acid extract to said carbonaceous chargestock as catalyst precursor.

BRIEF DESCRIPTION OF THE DRAWING

The FIGURE is a schematic flow plan of one embodiment of the invention.

DESCRIPTION OF THE PREFERRED EMBODIMENTS

Referring to the FIGURE, a carbonaceous chargestock comprising a metal-containing catalyst precursor introduced by line 12 in admixture with a hydrogen-containing gas introduced by line 14 is passed by line 10 into hydroconversion zone 1. The metal of the metal-containing catalyst precursor may be a single metal or a mixture of metals selected from the group consisting of vanadium and molybdenum. Preferably, the metal-containing catalyst precursor is a vanadium-containing catalyst precursor. Optionally, at the start of the process to provide an additional amount of the desired metals in the carbonaceous feed, a metal-containing catalyst or metal-containing catalyst precursor of the given metals may be introduced into the carbonaceous feed by line 16. Suitable metal-containing catalysts may be any of the known metal-containing catalysts of the stated metals adapted for use in slurry processes, such as metal oxide, metal sulfide, elemental metal of vanadium and molybdenum, which may be unsupported or supported. The support may be coal, coke, inorganic oxides such as alumina, silica, silica-alumina, magnesia and mixtures thereof. When an additional metal-containing material is used, it is preferably a thermally decomposable metal-containing catalyst precursor such as the catalyst precursors described in U.S. Pat. Nos. 4,134,825 and 4,192,735, the teachings of which are hereby incorporated by reference. The preferred catalyst precursor is vanadyl oxalate, that is, the vanadium salt of ethanedioic acid. The carbonaceous chargestock for the slurry hydroconversion process of the present invention may be a hydrocarbonaceous oil, coal and mixtures thereof. Suitable hydrocarbonaceous oil chargestocks include heavy mineral oils; whole or topped crude oil, including heavy crude oil; asphaltenes; residual oils such as atmospheric residua boiling above 650° F. at atmospheric pressure; petroleum vacuum residua boiling principally above 1050° F. at atmospheric pressure, tar; bitumen; tar sand oil; shale oil; hydrocarbonaceous oils derived from coal liquefaction bottom processes, including coal liquefaction bottoms. The Conradson carbon residue of such oils may generally be at least 2, preferably at least 5 weight percent and may generally range up to 50 weight percent or more. As to Conradson carbon residue, see ASTM Test D-189-65. The heavy oils generally contain a high content of metallic contaminants, nickel, iron, vanadium, usually present in the form of organometallic compounds and a high content of sulfur and nitrogen compounds. The term "coal" is used herein to designate normally solid carbonaceous materials including all ranks of coal such as anthracite coal, bituminous coal, semibituminous coal, subbituminous coal, lignite, peat and mixtures thereof. The process is applicable for the simultaneous conversion of mixtures of coal and a hydrocarbonaceous oil. The hydrogen-containing gas introduced into hydroconversion zone 1 may comprise from about 1 to 10 mole percent of hydrogen sulfide. Hydroconversion reaction zone 1 is maintained at a temperature ranging from about 650° to about 1000° F., preferably from about 799° to about 900° F. and a hydrogen partial pressure ranging from about 500 to about 5000 psig, preferably from about 1000 to about 3000 psig. The contact time in the hydroconversion zone may vary widely depending on the desired conversion level. Suitable space velocity, defined as volumes of oil feed per hour per volume of reactor (V/hr./V), may range from about 0.5 to 5.00, preferably from about 0.10 to 2.00, more preferably from about 0.15 to 1.00. The mixed phase product effluent of the hydroconversion zone is removed by line 18 and passed to gas-liquid separation zone 2 where it is separated by conventional means into a predominantly vaporous phase comprising light normally gaseous hydrocarbons and hydrogen removed by line 20 and a predominantly liquid phase removed by line 22. The vaporous phase may be further separated by conventional means to obtain a hydrogen-rich gas which, if desired, may be recycled to hydroconversion zone 1. The normally liquid hydrocarbon phase is passed by line 22 to separation zone 3 where it is separated by conventional means such as fractional distillation into a naphtha stream recovered by line 24, a middle distillate fraction recovered by line 25 and a residual fraction comprising the metals-containing solids recovered by line 26. The metals are derived from the metal-containing catalyst or metal catalyst precursor that was introduced into the chargestock as well as any metals that may be naturally occurring in the carbonaceous chargestock. If desired, a portion of the residual oil fraction comprising solids may be recycled to hydroconversion zone 1 by line 28. At least a portion of the residual oil fraction comprising the metal-containing solids is passed by line 26 to gasification zone 4 where the solids are contacted with a gas selected from the group of oxygen-containing gas (air or oxygen), steam and mixtures thereof to remove at least a portion of the carbon from the solids and produce a metal ash (i.e., metal oxides). The gasification conditions may be combustion conditions or conditions to produce a hydrogen-containing gas, such as, for example, a temperature ranging from about 800° to 2000° F. and a pressure ranging from 0 to 150 psig. The hydrogen-containing gas may be used as fuel gas or as gas in the hydroconversion zone. The gaseous product of the gasification zone is removed by line 30. An appropriate amount of metals-containing ash is purged from the process via line 34 and the balance of the metal-containing ash is removed by line 32 and passed to an extraction zone where it is contacted with oxalic acid (ethanedioic acid) in an aqueous solution. Oxalic acid is used in an amount sufficient to extract the metal (V, Mo) component of the metallic ash. Preferably, the oxalic acid is used in an amount at least sufficient to react theoretically stoichiometrically with the given metals that form the corresponding metal oxalates. More preferably, an amount in excess of the theoretical stoichiometric amount is utilized. If desired, extraneous ores or oxides comprising vanadium or molybdenum can be added to the extraction zone to provide a supplemental source of catalytic metals. Suitable extraction conditions include a temperature ranging from 80° to 300° F. and a pressure ranging from 0 to 100 psig. The contact of the aqueous oxalic acid preferentially extracts the vanadium and molybdenum from the metal-containing ash. The aqueous oxalic acid extract comprising the extracted metals is removed by line 12 from extraction zone 5. If desired, at least a portion of the water may be removed from the oxalic acid extract. Alternatively, at least a portion of the oxalic acid extract without water removal is passed by line 12 to mix with the carbonaceous feed in line 10. The oxalic acid extract is a hydroconversion catalyst precursor, which, at hydroconversion conditions, yields a solid metal-containing catalyst corresponding to the metal or metals that were extracted. If desired, the carbonaceous feed comprising the oxalic acid extract may be preheated at conditions to decompose the metal-containing extract to a solid metal-containing catalyst prior to subjecting the carbonaceous feed to hydroconversion conditions. The metal-containing oxalic acid extract is mixed with a carbonaceous chargestock such as to provide about 10 to 2000 wppm metals of vanadium or molybdenum or mixtures thereof, calculated as elemental metals, based on the weight of the carbonaceous chargestock, preferably from about 50 to 1500 wppm metal to carbonaceous chargestock, more preferably from about 100 wppm to about 800 wppm (weight parts per million) metal based on the weight of the carbonaceous chargestock. When the chargestock is coal, the metal concentration is based on coal alone; when the feed is a hydrocarbonaceous oil, it is based on the oil; when the chargestock is a mixture of coal and oil, it is based on the weight of the coal and oil. After the start of the process, the addition of metal-containing catalyst or catalyst precursor via line 16 may be discontinued or only a sufficient amount of additional metal-containing material may be added to make up the desired amount of metal, if the amount of metal introduced by line 12 is insufficient to provide the desired amount of metal catalyst precursor.

The following examples are presented to illustrate the invention.

COMPARATIVE EXPERIMENT 1

Hydroconversion with Catalyst Precursor Comprising Vanadyl Oxalate

Hydroconversion experiments were performed utilizing as feed an Arabian vacuum residue having a Conradson carbon content of 21 weight percent, a vanadium content of 186 wppm, a nickel content of 53 wppm and an initial boiling point of 900° F.

The vanadyl oxalate ($VOC_2O_4$) catalyst precursor was used as an oil dispersed precursor concentrate which was prepared in the following manner. To a 300 cc stirred, Autoclave Engineers autoclave there was charged 10.0 g of an aqueous solution of vanadyl oxalate (4 weight percent V in solution) and 98.72 g of heavy Arabian atmospheric residuum which had an initial boiling point of 600° F. The autoclave was flushed with nitrogen, pressured to 250 psi with nitrogen and then heated to 302° F. for a 15-minute stirred period under 300 psi pressure, whereupon pressure was released and water was removed from the autoclave in a flowing stream of nitrogen. Water removal was completed by a further 10-minute period of stirring at 347° F. with nitrogen flow. The resultant precursor preparation, which contained 0.4 weight percent V, was cooled to room temperature and discharged.

Hydroconversion experiments were carried out at two vanadium concentrations in the reactor liquid, 650 wppm and 800 wppm. The reactor charge (300 cc autoclave) for the former consisted of 16.25 g of catalyst precursor concentrate and 83.75 g of heavy Arab vacuum residuum, and for the latter 20 g of concentrate and 80 g of vacuum residuum.

In carrying out the hydroconversion experiments the 300 cc autoclave reactor containing the charge of catalyst precursor concentrate, and vacuum residuum specified above was flushed with hydrogen and then heated from room temperature to 158° F. for a 15-minute stirred contact. Upon cooling to room temperature the reactor was charged with 50 psi $H_2S$ and 1350 psi $H_2$, then heated from room temperature to 725° F. and maintained at 725° F. with stirring for a period of 20 minutes. At this point, the pretreatment step of the hydroconversion experiment was complete. Reactor pressure was then adjusted to 2100 psi, $H_2$ flow was begun, reactor temperature was increased to a hydroconversion reaction temperature of 830° F. and a hydroconversion run of three hours duration was carried out at 2100 psi total pressure while maintaining a gas flow (measured at reactor outlet after removal of $H_2S$) of 0.302 liters/minute.

In the course of the hydroconversion run approximately 20–30 weight percent of the hydrocarbons charged was distilled from the reactor in the form of 650−° F. liquid and gaseous products, which products were collected and analyzed. The 650+° F. products (along with some 650−20 F. liquids) that remained in the reactor after the hydroconversion reaction was complete and the reactor cooled to room temperature and vented, were diluted with three weights of toluene, based on the weight of residuum charged initially, and then filtered to recover toluene insoluble residues (a predominantly carbonaceous material which contains catalyst metal and metal residues displaced from the feed) and a solids-free product oil. The solids, after washing with toluene to remove adhering oil and vacuum oven drying, were weighed and designated toluene insoluble coke. After distillation to remove the bulk of toluene diluent the solids-free product oil was analyzed for Conradson carbon content.

Experimental results (Table I) showed that vanadyl oxalate yielded an effective hydroconversion catalyst; one that achieves a high level of conversion of Conradson carbon material (coke precursor) to noncoke materials, i.e., the weight fraction of Conradson carbon converted to coke (the coke producing factor) is low.

TABLE I

RESULTS OF HYDROCONVERSION EXPERIMENTS WITH CATALYST PRECURSOR COMPRISING VANADYL OXALATE

| Experiment No. | R-1299 | R-1285 |
|---|---|---|
| V on Reactor Liquid, wppm | 650 | 800 |
| Toluene Insoluble Coke Yield, Wt. % on HAVR* | 2.04 | 1.69 |
| Conradson Carbon Conv., % | 68.7 | 69.3 |
| Coke Producing Factor | 0.14 | 0.12 |

*Heavy Arabian Vacuum Residuum

EXAMPLE 1

Preparation of Oxalic Acid Extract From Vanadium-Containing Process Ash and Evaluation as Catalyst Precursor A sample of 15.56 g of toluene insoluble coke residues obtained from the hydroconversion products of eight hydroconversion experiments carried out with added vanadium catalysts was burned in air for 16 hours at 850° F. and then for an additional 4 hours at 950° F. There was recovered 0.94 g of fluffy orange-green ash which was estimated, based on the composition of the toluene insoluble coke, to contain approximately 50 weight percent vanadium along with an aggregate of 5 weight percent nickel and iron.

The oxalic acid extract was prepared by refluxing this 0.94 g ash, 1.9 g oxalic acid and 13.12 g deionized water for one hour. Upon filtering the reaction mixture there was recovered 0.2 g of pale green powder (weighed after water washing and vacuum oven drying) and a deep blue filtrate, which was concentrated to a total weight of 12.46 g. Analyses on the liquid-extract and filtered solids product (Table II) show that oxalic acid extraction provides an effective and reasonably selective method for recovering vanadium from process ash.

TABLE II

RESULTS OF OXALIC ACID EXTRACTION

| | Grams Metal Contained In | |
|---|---|---|
| | Extract | Residual Solids |
| V | 0.353 | 0.009 |
| Ni | 0.044 | 0.030 |
| Fe | 0.010 | 0.005 |

An oil-dispersed catalyst precursor concentrate was prepared by blending 10.6 g of the oxalicacid extract with 75.3 g of heavy Arabian atmospheric residuum according to the procedure given in Comparative Experiment 1 for the preparation of the oil-dispersed concentrate containing vanadyl oxalate. The vanadium content of the finished precursor concentrate was 0.4 weight percent.

Hydroconversion activity of the vanadium-extract based, oil-dispersed precursor concentrate was determined using the hydroconversion procedure described in Comparative Experiment 1. The reactor charge consisted of 80 g of heavy Arabian vacuum residuum and 20 g of the concentrate, which was an amount sufficient to give a vanadium concentration of 800 wppm on total reactor liquid (i.e., the combined weight of vacuum and atmospheric residuum components). Hydroconversion results obtained using the vanadium-extract based catalyst precursor concentrate compare favorably with those obtained using a precursor concentrate prepared with the commercial sample of vanadyl oxalate (Table III).

TABLE III

RESULTS OF HYDROCONVERSION EXPERIMENTS WITH CATALYST PRECURSOR COMPRISING VANADIUM-EXTRACT

| Experiment No. | R-1285 | R-1479 |
|---|---|---|
| Precursor Source | Vanadyl Oxalate | Oxalic Acid Extract |
| V on Total Reactor Liquid, wppm | 800 | 800 |
| Toluene Insoluble Coke, Wt. % on HAVR* | 1.69 | 2.15 |
| Conradson Carbon Conversion, % | 69.3 | 67.0 |
| Coke Producing Factor | 0.12 | 0.15 |

*Heavy Arabian Vacuum Residuum

COMPARATIVE EXPERIMENT 2

Evaluation of Molybdenum Oxalate and Phosphomolybdic Acid as Hydroconversion Catalyst Precursors The oil-dispersed precursor concentrate containing molybdenum oxalate ($MoO_3.C_2H_2O_4$) was prepared by mixing 10.41 g of an aqueous solution of molybdenum oxalate with 99 g of heavy Arabian atmospheric residuum according to the procedure given in Comparative Experiment 1 for preparation of the vanadyl oxalate precursor dispersion. For the subsequent hydroconversion experiment the reactor was charged with 87.5 g of heavy Arabian vacuum residuum, 3.25 g of heavy Arabian atmospheric residuum and 8.75 g of the oil-dispersed catalyst concentrate, an amount which furnished 350 wppm on total reactor liquids, i.e., atmospheric and vacuum residua.

For the experiment using phosphomolybdic acid as catalyst precursor, an oil dispersed precursor concentrate was used which was prepared in the following manner. To a 1000 cc Autoclave Engineers stirred autoclave there was added 8 g of a phenol solution of phosphomolybdic acid (10 weight percent Mo in solution) and 392 g of heavy Arabian atmospheric residuum. The autoclave was flushed with argon, then heated with stirring from room temperature to 300° F. and stirred at this temperature for 30 minutes, whereupon the autoclave was cooled and the precursor concentrate (contains 0.2 weight percent Mo) discharged. In the subsequent hydroconversion experiment 20 g of this concentrate was charged to the 300 cc autoclave reactor along with 80 g of heavy Arabian atmospheric residuum; thus providing a Mo concentration of 400 wppm on the total amount of liquid in the reactor.

The results of hydroconversion experiments, which were carried out according to the procedure described in Comparative Experiment 1, are given in Table IV. Within experimental error, and given the slight difference in Mo concentration between the two experiments, it can be concluded that catalysts of comparable activity were obtained from molybdenum oxalate and from phosphomolybdic acid. Toluene insoluble coke yields are comparable as is Conradson carbon conversion.

TABLE IV

COMPARISON OF MOLYBDENUM OXALATE AND PHOSPHOMOLYBDIC ACID AS HYDROCONVERSION CATALYST PRECURSORS

| Experiment No. | R-1309 | R-1264 |
|---|---|---|
| Precursor | Molybdenum Oxalate | Phosphomolybdic Acid |
| Mo on total Reactor Liquid, wppm (Atmos. + Vac. Resid) | 350 | 400 |
| Toluene Insoluble Coke Yield, Wt. % on HAVR* | 1.6 | 1.4 |
| Conradson Carbon Conv., % | 72 | 72 |

*Heavy Arabian Vacuum Residuum

EXAMPLE 2

Preparation of Oxalic Acid Extract of Mo-Containing Process Ash and Evaluation as Catalyst Precursor A sample of 45 g of toluene insoluble coke obtained from the hydroconversion upgrading of heavy Arabian vacuum residuum in continuous unit operations under hydroconversion reaction conditions described in Comparative Experiment 1 and using an oil-dispersed concentrate of phosphomolybdic acid as catalyst precursor, was burned in air for 16 hours at 850° F. and then for an additional 4 hours at 950° F. There was recovered 2.55 g of a fluffy olive-green ash which contained 21.6 weight percent Mo, 16.35 weight percent V and 4.97 weight percent Ni.

To prepare the oxalic acid extract, 2.0 g of the ash was mixed with 3.52 g of oxalic acid monohydrate ($C_2H_2O_4.H_2O$) dissolved in 22 g of deionized water and heated at 100° C. for one hour. The resultant reaction mixture was filtered through a No. 2 Whatman paper to obtain 0.4 g of pale-green water insoluble powder and a deep blue filtrate which was concentrated to 11.0 g. As noted in Table V, extraction of molybdenum and vanadium (see also Example 1), both effective metals for hydroconversion catalysis, is largely complete; whereas nickel, a less effective catalytic metal than either V or Mo, is mainly found in the water insoluble (reject) solids. Note that in Table V, the materials balances varied but were within the limits of analytical accuracy.

TABLE V

PREPARATION OF OXALIC ACID EXTRACT

| | Grams Metal Charged in 2 g of Ash | Grams Metal Recovered In | |
|---|---|---|---|
| | | Extract | Insol. Solids |
| Mo | 0.432 | 0.360 | 0.009 |
| V | 0.327 | 0.356 | 0.030 |
| Ni | 0.100 | 0.037 | 0.076 |

An oil-dispersed catalyst precursor concentrate was prepared by blending 10 g of extract with 99 g of heavy Arabian atmospheric residuum according to the procedure given in Comparative Experiment 1 for the preparation of the vanadyl oxalate precursor concentrate. The Mo content of the finished concentrate was 0.329 weight percent.

The effectiveness of the extract-based catalyst precursor was determined using the hydroconversion test procedure described in Comparative Experiment 1, and the reactor charge, excluding gases, consisted of 109.5 g heavy Arabian vacuum resid, 1.3 g heavy Arabian atmospheric resid and 9.2 g of the oil-dispersed extract based precursor concentrate, an amount which furnished 250 wppm Mo on the total charge of hydrocarbon feed, i.e., atmospheric plus vacuum residua. Experimental results are compared with those obtained using 250 wppm fresh molybdenum furnished as the oil-dispersed precursor concentrate of molybdenum oxalate (Table VI), also prepared according to the procedure of Comparative Experiment 1. As noted, at the 250 wppm Mo-on-feed basis the extract precursor is considerably more effective than the fresh molybdenum oxalate.

TABLE VI

COMPARISON OF MOLYBDENUM OXALATE AND OXALIC ACID EXTRACT AS CATALYST PRECURSORS

| Run No. | R-1445 | R-1297 |
|---|---|---|
| Mo Source | Oxalic Acid Extract | Molybdenum Oxalate |
| Mo on Total Reactor Liquid, wppm | 250 | 250 |
| Toluene Insol. Coke, Wt. % on HAVR* | 1.83 | 3.32 |
| Conradson Carbon Conv., % | 67.4 | 66.7 |

TABLE VI-continued

| COMPARISON OF MOLYBDENUM OXALATE AND OXALIC ACID EXTRACT AS CATALYST PRECURSORS | | |
|---|---|---|
| Run No. | R-1445 | R-1297 |
| Coke Producing Factor | 0.05 | 0.24 |

*Heavy Arab. Vacuum Residuum

What is claimed is:

1. In a slurry hydroconversion process wherein a carbonaceous chargestock containing a catalyst or catalyst precursor comprising a metal selected from the group consisting of vanadium, molybdenum and mixtures thereof, is reacted with a hydrogen-containing gas at hydroconversion conditions to produce a hydroconverted oil product comprising solids containing said metals, separating a heavy oil portion comprising said metal-containing solids from said hydroconverted oil; gasifying at least a portion of said separated heavy oil portion to produce a metal-containing ash, the improvement which comprises contacting said metal-containing ash with oxalic acid to extract said metal from said ash, and adding at least a portion of the resulting metal-containing oxalic acid extract to said carbonaceous chargestock as catalyst precursor.

2. The process of claim 1 wherein said metal-containing oxalic acid extract is added to said carbonaceous chargestock in an amount sufficient to provide from about 10 to 2000 wppm metal of said metals, calculated as elemental metal, based on said carbonaceous chargestock.

3. The process of claim 1 wherein said oxalic acid is used in at least a stoichiometric amount sufficient to form a metal oxalate of said metal.

4. The process of claim 1 wherein said oxalic acid is contacted with said metal-containing ash at a temperature ranging from 80° to 300 F. and a pressure ranging from 0 to 100 psig.

5. The process of claim 1 wherein said hydroconversion conditions include a temperature ranging from 650° to 1000° F. and a hydrogen partial pressure ranging from 500 to 5,000 psig.

6. The process of claim 1 wherein said gasification conditions include a temperature ranging from 800° to 2000° F. and a pressure ranging from 0 to 150 psig.

7. The process of claim 1 wherein at least a portion of said separated heavy oil is recycled to said hydroconversion zone.

8. The process of claim 1 wherein said carbonaceous chargestock comprises a hydrocarbonaceous oil.

9. The process of claim 1 wherein said carbonaceous chargestock comprises coal.

10. The process of claim 1 wherein said catalyst or catalyst precursor comprises vanadium.

11. The process of claim 1 wherein said catalyst has been prepared in situ in said feed from a catalyst precursor.

12. The process of claim 1 wherein said catalyst precursor comprises vanadyl oxalate.

13. A slurry hydroconversion process comprising the steps of:

(a) adding an oxalic acid extract comprising a metal selected from the group consisting of vanadium, molybdenum and mixtures thereof recycled from step (f) as catalyst precursor to a carbonaceous chargestock to form a mixture;

(b) reacting said mixture with a hydrogen-containing gas at hydroconversion conditions to produce a hydroconverted oil product comprising solids containing said metal;

(c) separating a heavy oil portion comprising said metal-containing solids from said hydroconverted oil;

(d) gasifying at least a portion of said separated heavy oil portion to produce a metal-containing ash;

(e) contacting said metal-containing ash with oxalic acid to extract said metal from said ash, and (f) adding at least a portion of the resulting metal-containing acid extract to said carbonaceous chargestock as said catalyst precursor.

* * * * *